US010309594B1

(12) United States Patent
Baldwin et al.

(10) Patent No.: US 10,309,594 B1
(45) Date of Patent: Jun. 4, 2019

(54) STACK LIGHT

(71) Applicants: Christopher M. Baldwin, Avon, IN (US); Mark T. Monnett, Cloverdale, IN (US)

(72) Inventors: Christopher M. Baldwin, Avon, IN (US); Mark T. Monnett, Cloverdale, IN (US)

(73) Assignee: Mallory Sonalert Products, Inc., Indianapolis, IN (US)

( * ) Notice: Subject to any disclaimer, the term of this patent is extended or adjusted under 35 U.S.C. 154(b) by 0 days.

(21) Appl. No.: 15/583,314

(22) Filed: May 1, 2017

(51) Int. Cl.

| | |
|---|---|
| ***F21V 21/00*** | (2006.01) |
| ***F21S 6/00*** | (2006.01) |
| ***F21V 23/06*** | (2006.01) |
| ***F21V 23/00*** | (2015.01) |
| ***F21V 33/00*** | (2006.01) |
| ***H04R 17/00*** | (2006.01) |
| ***H04R 1/02*** | (2006.01) |
| ***H04R 1/28*** | (2006.01) |
| *F21Y 115/10* | (2016.01) |

(52) U.S. Cl.
CPC ..... *F21S 6/006* (2013.01); *F21V 23/003* (2013.01); *F21V 23/06* (2013.01); *F21V 33/0056* (2013.01); *H04R 1/028* (2013.01); *H04R 1/2811* (2013.01); *H04R 17/00* (2013.01); *F21Y 2115/10* (2016.08)

(58) Field of Classification Search
CPC ..... F21S 6/006; F21S 8/081; F21V 23/003; F21V 23/006; F21V 33/0056; H04R 1/028; H04R 1/2811; H04R 17/00; F21Y 2115/10
USPC ..... 362/86, 367, 330, 89
See application file for complete search history.

(56) References Cited

U.S. PATENT DOCUMENTS 1,035,745 A 8/1912 Rubes
3,532,876 A * 10/1970 Muller et al. ..... F21V 5/02 362/330

(Continued)

OTHER PUBLICATIONS

Patlite LU7-LB catalog page, undated, 1 page. Retrieved from the Internet Aug. 10, 2016.

(Continued)

*Primary Examiner* — Laura K Tso
(74) *Attorney, Agent, or Firm* — William F. Bahret

(57) ABSTRACT

A stack light with a light section having a housing with a plurality of at least partially translucent side walls and having a plurality of opposing light sources on longitudinally opposite ends of the housing to produce a very even blended light. A stack light system with one or more such light sections also includes a sound section having a hollow housing and a set of interchangeable acoustic chambers configured for insertion into the hollow housing, each chamber including a piezoelectric transducer and having a side wall structure configured to abut an inner side wall surface of the hollow housing, the chamber, transducer and housing together defining a resonant cavity. In one embodiment, an acoustic chamber has a longitudinally extending side wall and a substantially closed end wall, the side wall having adjacent the end wall a plurality of wide lateral openings spaced apart along its perimeter, the openings each having a width in the range of approximately 8-25% of the wavelength of the piezoelectric transducer's fundamental frequency.

22 Claims, 9 Drawing Sheets

(56) References Cited

U.S. PATENT DOCUMENTS

| | | | | |
|---|---|---|---|---|
| 3,663,931 | A | 5/1972 | Brown | |
| 3,873,866 | A | 3/1975 | Goble | |
| 4,156,156 | A | 5/1979 | Sweany et al. | |
| 4,602,245 | A | 7/1986 | Yang et al. | |
| 5,952,915 | A * | 9/1999 | Marquardt | F21V 23/06 340/332 |
| 6,130,618 | A | 10/2000 | Burnett et al. | |
| 6,166,623 | A | 12/2000 | Coward | |
| 6,310,540 | B1 | 10/2001 | Burnett et al. | |
| 6,512,450 | B1 | 1/2003 | Burnett et al. | |
| 6,750,760 | B2 | 6/2004 | Albritton et al. | |
| 6,814,610 | B2 | 11/2004 | Kurose et al. | |
| 6,987,445 | B1 | 1/2006 | Burnett et al. | |
| 7,445,360 | B2 * | 11/2008 | Ikeda | F21S 8/083 362/268 |
| 7,492,276 | B2 | 2/2009 | Fayfield | |
| 7,588,343 | B1 * | 9/2009 | Carter | E04C 3/36 362/152 |
| 8,382,347 | B2 * | 2/2013 | McCanless | F21S 8/088 362/249.02 |
| 8,674,817 | B1 | 3/2014 | Baldwin et al. | |
| 8,797,176 | B1 | 8/2014 | Baldwin et al. | |
| 9,030,318 | B1 | 5/2015 | Baldwin et al. | |
| 9,165,440 | B1 | 10/2015 | Baldwin et al. | |
| 9,307,309 | B2 | 4/2016 | Feller et al. | |
| 2003/0030567 | A1 * | 2/2003 | Hetzel | G08B 5/38 340/815.4 |
| 2007/0057777 | A1 | 3/2007 | Burnett et al. | |
| 2007/0057778 | A1 | 3/2007 | Prince, Jr. et al. | |
| 2013/0314916 | A1 * | 11/2013 | Clore | F21V 5/04 362/235 |
| 2015/0198317 | A1 * | 7/2015 | Feller | H05B 33/0842 362/249.01 |
| 2016/0209017 | A1 * | 7/2016 | Feller | H04R 1/028 |

OTHER PUBLICATIONS

Patlite LU7-LB Manual, undated, 2 pages. Retrieved from the Internet Aug. 10, 2016.

Patlite LU7-LB Specifications, undated, 2 pages. Retrieved from the Internet Aug. 10, 2016.

Banner CL50 Column Light Data Sheet, P/N 145315 Rev. G, Dec. 21, 2012, Banner Engineering Corp., 7 pgs.

Patlite ME-A/MES-A Signal Tower Data Sheet, undated, Patlite Corporation, 1 pg.

Patlite ME-A/MP Installation Manual, undated, Patlite Corporation, 4 pgs.

* cited by examiner

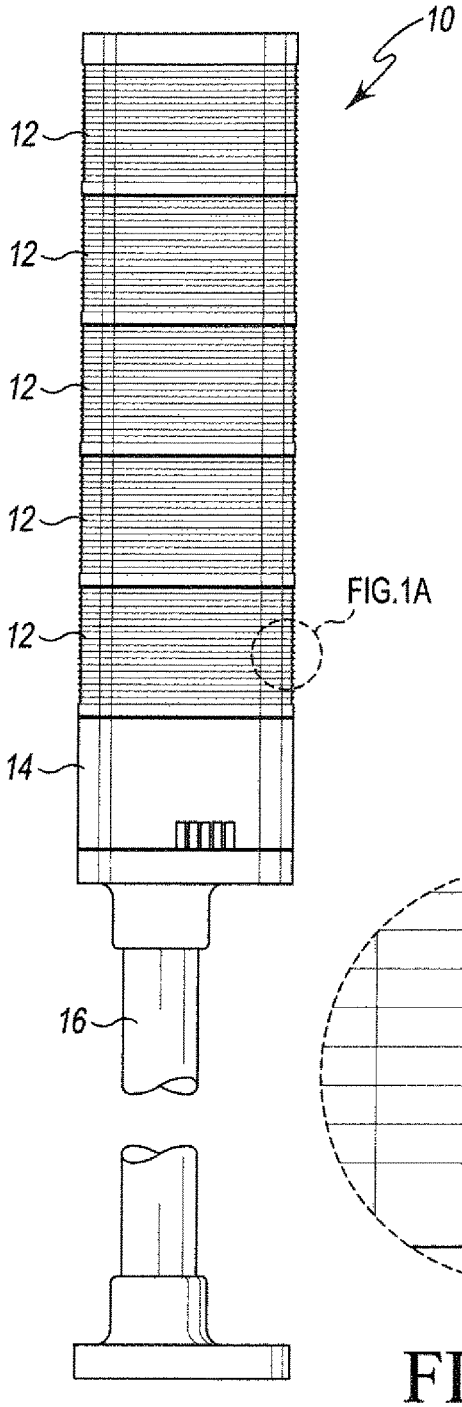
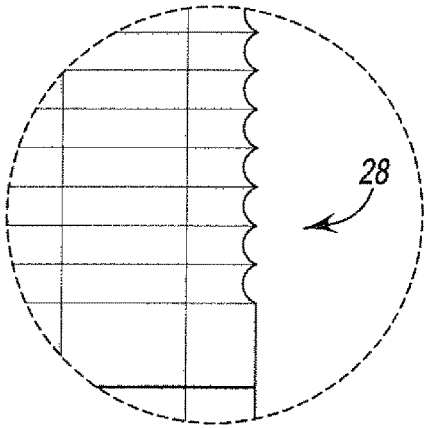
FIG. 1A
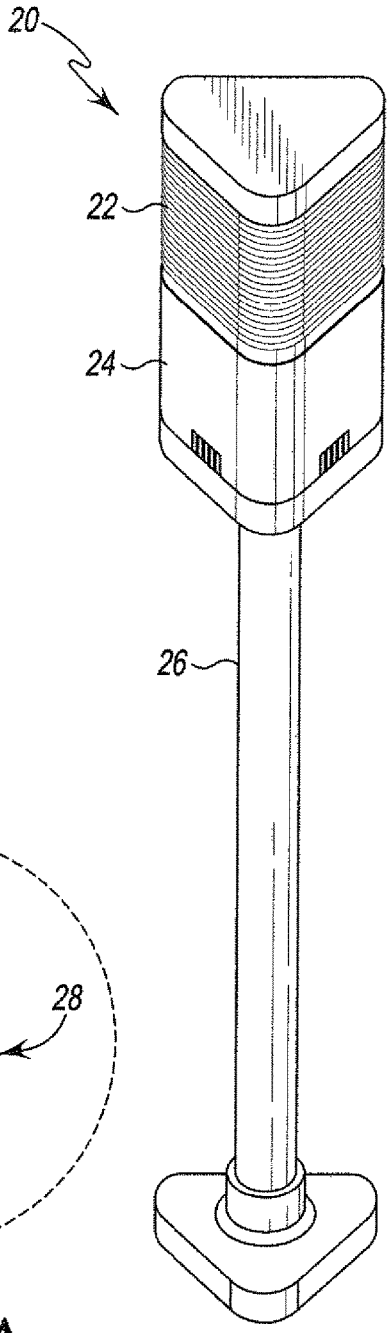
FIG. 1
FIG. 2

STACK LIGHT

BACKGROUND OF THE INVENTION

This invention relates to indicator devices and more particularly to stack lights, also known as light towers or tower lights. Indicator devices such as stack lights have been used in industrial control applications including industrial machinery such as machine tools, other metalworking and material processing equipment, assembly line equipment, and the like. Stack lights are typically mounted and electrically connected to the top of a machine to help the machine operator, supervisor, or anyone else in the area visually and audibly quickly identify the status of the machine. In the past, a round light tower emitting a continuous light and sound did an adequate job. However, devices having such limited functionality have not kept pace with machines as they continue to become more sophisticated in function.

SUMMARY OF THE INVENTION

The present invention provides an improved stack light, one aspect of which is a novel configuration of a light section having a housing with a plurality of at least partially translucent side walls and having a plurality of opposing light sources on longitudinally opposite ends of the housing to produce a very even blended light.

Another aspect of the invention is a stack light system with stacked light and sound sections aligned on an axis, the system comprising a light section having a housing with a light source therein, and a sound section having a hollow housing and a set of interchangeable acoustic chambers configured for insertion into the hollow housing, each chamber including a piezoelectric transducer and having a side wall structure configured to abut an inner side wall surface of the hollow housing, the chamber, transducer and housing together defining a resonant cavity.

According to another aspect of the invention, in a stack light with light and sound sections on a common longitudinal axis, the light section has a housing with a light source therein, and the sound section has an acoustic chamber with a piezoelectric transducer, a longitudinally extending side wall, and a substantially closed end wall, the side wall having adjacent the end wall a plurality of wide lateral openings spaced apart along its perimeter, the openings each having a width in the range of approximately 8-25% of the wavelength of the piezoelectric transducer's fundamental frequency.

BRIEF DESCRIPTION OF THE DRAWINGS

FIG. 1 is a side view of a five-section stack light, one embodiment of the present invention, and FIG. 1A is an enlarged view of the circled portion thereof.

FIG. 2 is a side view of an embodiment of the invention having one light section and one sound section.

The drawings are scale drawings. FIGS. 4-10 have the same scale as each other.

DESCRIPTION OF PREFERRED EMBODIMENTS

Figure 3:
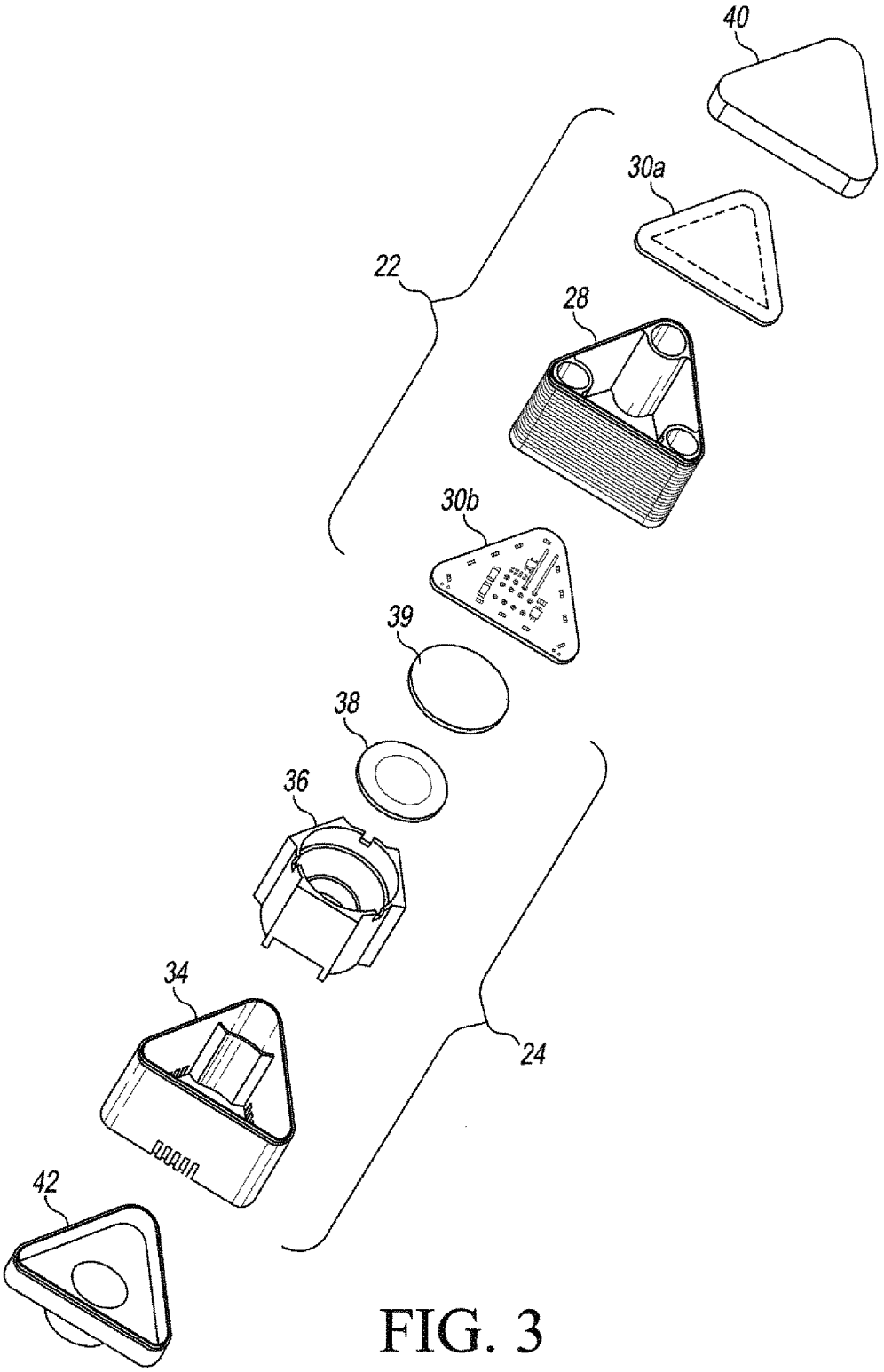
FIG. 3 is an exploded view of the two-section stack light of FIG. 2.
Figure 4:
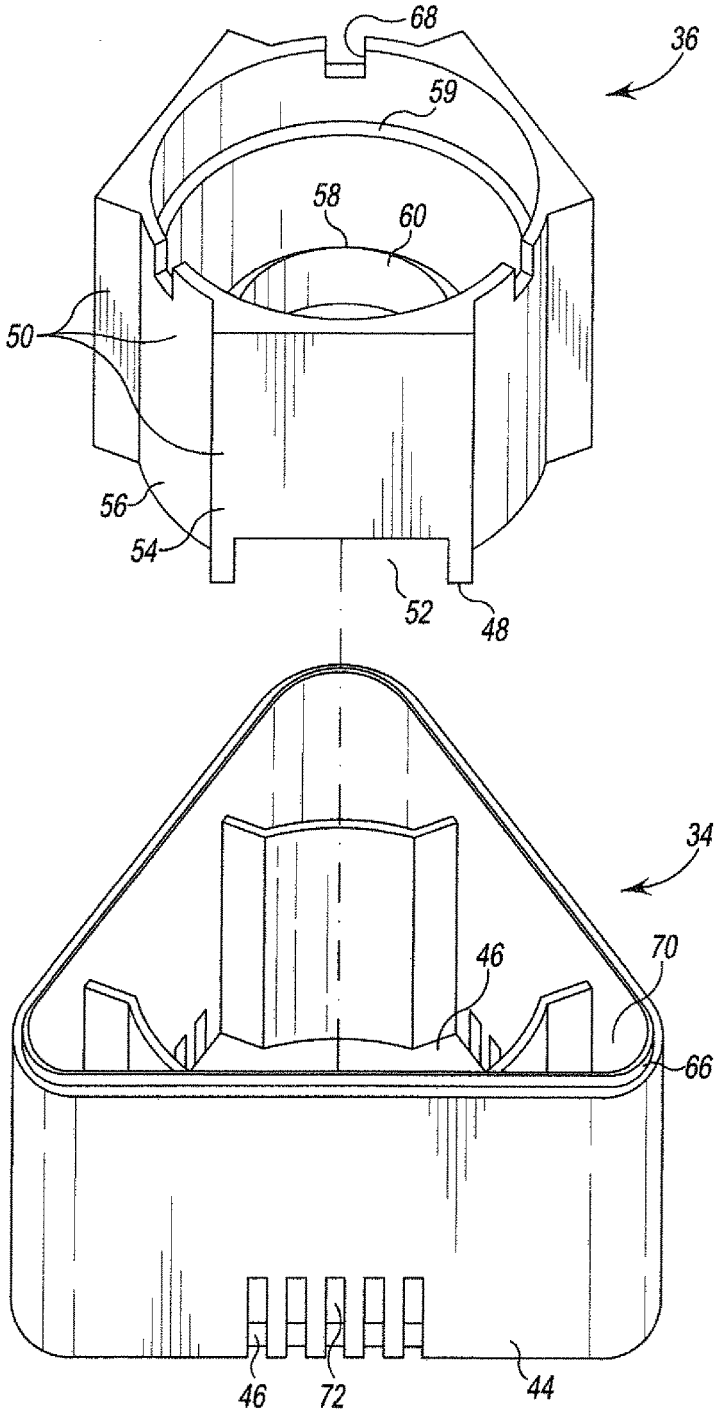
FIG. 4 is an exploded, upper perspective view of a sound section that may be utilized in the embodiments of FIGS. 1 and 2.
Figure 5:
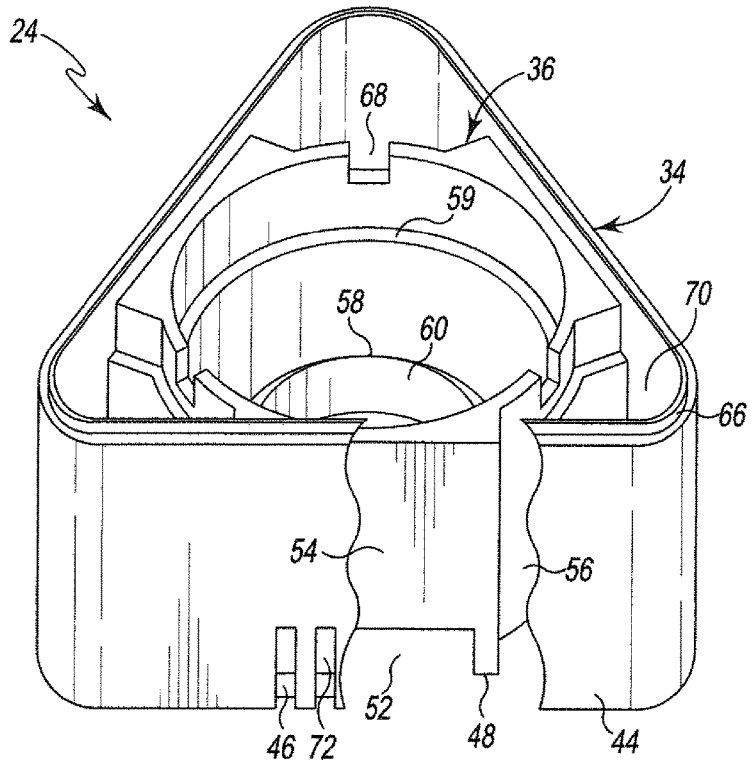
FIG. 5 is an upper perspective view of the assembled sound section of FIG. 4, with a wall of the external housing partially cut away to show part of the acoustic chamber within.
Figure 6:
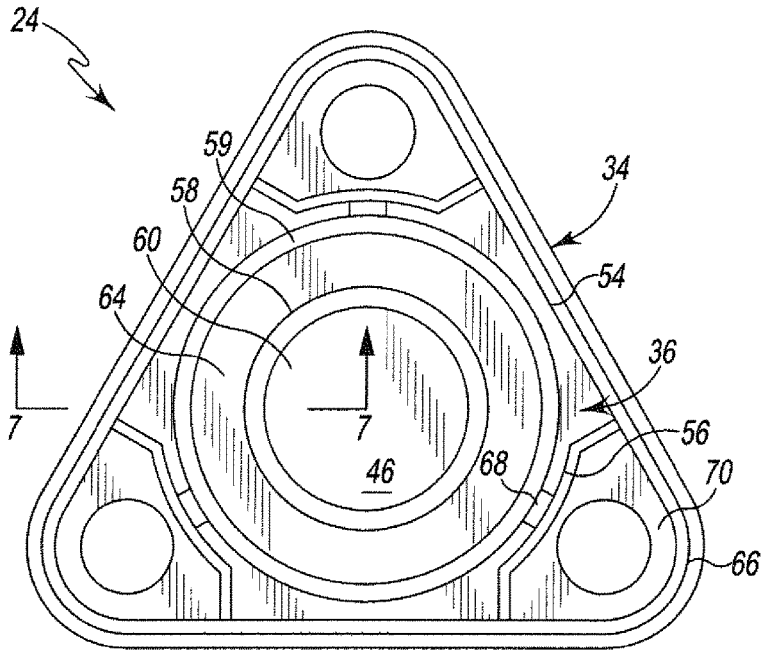
FIG. 6 is a top view of the sound section of FIG. 5.
Figure 7:
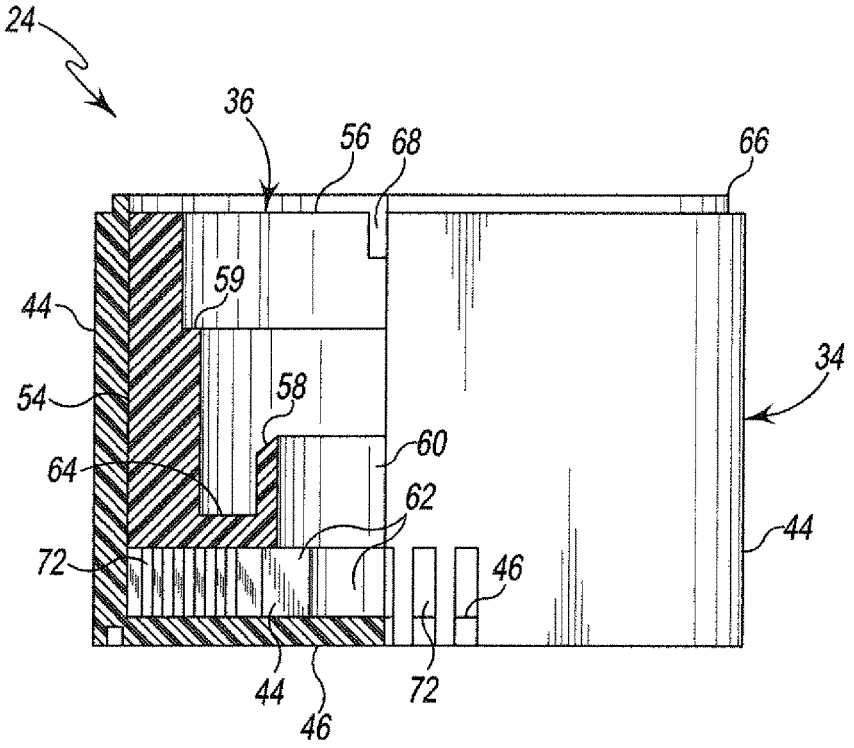
FIG. 7 is a side sectional view of the sound section taken along line 7-7 in FIG. 6, showing a partial cross-section of the acoustic chamber within the external housing.

For the purpose of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device and such further applications of the principles of the invention as illustrated therein being contemplated as would normally occur to one skilled in the art to which the invention relates.

One embodiment of a stack light 10 according to the present invention has five light sections 12 and one sound section 14 interconnected as shown in FIG. 1 and mounted on a pole 16 by which the stack light may be mounted on a machine. FIG. 2 shows a second embodiment of a stack light 20 which has one light section 22 and one sound section 24 interconnected and mounted on a pole 26. In these embodiments, the sound section preferably utilizes a piezoelectric transducer or speaker and is designed to have interchangeable acoustic sound chambers so that multiple sound frequency options can be offered for the same size external package.

As will be understood by those skilled in the art, an acoustic chamber is an enclosed space or cavity that exhibits acoustic resonance in response to excitation at one or more characteristic frequencies known as its resonant frequency or frequencies, which depend on internal cavity dimensions and geometry. The use of an acoustic sound chamber in an audible device can give significant efficiencies in sound level, power, and size over devices not having an acoustic sound chamber. Specifically, the use of an acoustic sound chamber can enable generation of a very loud sound level, but with the limitation of a narrow range of sound frequencies. Thus, different rated sound frequencies conventionally require acoustic chambers of different physical dimensions. For a board level or panel level audible device, the practical implementation of this sound frequency limitation is that different external package sizes are designed around different rated sound frequencies. For example, Mallory Sonalert offers panel-mount alarm Model No. SCE028XD3CTB in a 1.7"×1.4" (diameter×length) package which emits a very loud sound level at a rated frequency of 2900 Hz. Mallory Model No. SCE028XD2CTB is the same except for its length, 1.9", and emits a similar very loud sound level at a rated frequency of 2000 Hz. The 2000 Hz alarm is 35% longer than the 2900 Hz alarm because the acoustic sound chamber is significantly larger such that it requires a change in the outside package shape.

While it is feasible to offer many different package sizes of board and panel level audible devices based around different rated sound frequencies, it is not practical to do so for more complex and expensive indicator devices such as light towers, or stack lights. This is because a stack light is made up of multiple sections that are physically and electrically connected together. To maintain the environmental, electrical, physical integrity, and visual aesthetics of the stack light, it is desirable and in some cases important to have matching external shapes for the individual sections. This limits the opportunity to significantly change the shape or size of the audible section of the stack light which contains the acoustic sound chamber. The practical implementation of this limitation in current state-of-the-art stack lights is that a stack light series based on one physical package design has only one sound frequency option available.

The stack lights of FIGS. 1 and 2 overcome this limitation because they are designed to have internal interchangeable acoustic chambers which enable the entire device to have many different sound frequency options in the same external package. Referring to FIG. 3, stack light 20 has a light section 22 and a sound section 24 mounted on a common longitudinal axis. Light section 22, as further described below, has a housing or lens 28 with printed circuit boards (PCBs) 30*a* and 30*b* attached on opposite ends thereof and interconnected by rigid board-to-board connector pins 32 which pass through otherwise unfilled space within the housing. Sound section 24 includes a hollow external shell or housing 34, a mating acoustic chamber 36 shaped and sized for insertion into the housing, and a sound generating element, preferably a piezoelectric transducer 38, operatively associated therewith, the transducer being electrically connected to a transducer drive circuit on a printed circuit board 39. End caps 40 and 42 are provided on the upper end of the light section and lower end of the sound section, respectively, held on with an adhesive, e.g., SCIGRIP 4707. The housings, acoustic chambers and end caps may be made of ABS FR15U plastic.

An acoustic chamber is conventionally understood to include side and end walls fully enclosing a cavity except for one or more sound outlet orifices. The term "acoustic chamber" is used herein in that sense and also to include partially open structures of that type, including in particular chamber 36, which is open on both ends and formed as a separate molded plastic part in the embodiment of the invention illustrated in the drawings. External shell or housing 34 provides a closed end wall for acoustic chamber 36, and thus for the assembled acoustic chamber, in this embodiment. In an alternative embodiment, an acoustic chamber has side and end walls that are integrally formed, e.g., as a single molded part, with sound opening(s) in the side and/or end walls. As another alternative, the external housing may be molded with a desired exterior shape, e.g., polygonal such as triangular, quadrilateral, octagonal, etc., and with a cylindrical interior shape and an end wall defining an acoustic chamber, all as a single molded part. Other interior shapes are also contemplated for the acoustic chamber, including conical and polygonal.

As shown in further detail in FIGS. 4-8, which illustrate a sound section that may be utilized in the embodiments of FIGS. 1 and 2, external housing 34 may have three flat side walls 44 with rounded corners, and provides a closed end wall 46 for acoustic chamber 36, and thus for the assembled acoustic chamber. More particularly, end wall 46 preferably has a flat inner surface, and the bottom end 48 of the side wall structure 50 of the acoustic chamber is contiguous with that surface except for lateral openings 52 in the side wall 50, such that, with transducer 38, the assembled acoustic chamber has side and end walls fully enclosing a cavity except for one or more sound outlet orifices. Side wall structure 50, transducer 38 and closed-end housing 34 are interconnected so as to collectively define a resonant cavity. Side wall structure 50 includes three spaced side wall segments 54 with flat outer surfaces alternating with three cylindrically shaped side wall segments 56, and has a stepped cylindrical inner surface. The acoustic chamber is configured for slidable insertion into the housing, and configured to have its side wall segments 54 abut the flat inner surfaces of the side walls of housing 34 although not necessarily on all three sides simultaneously, a slight tolerance or gap being contemplated to facilitate insertion. Alternatively, chamber 36 may be configured for an interference fit or a taper lock. For example, the chamber may be molded with a draft angle, i.e., a slight taper from top to bottom. The closely fitting chamber's three flat outer surfaces are parallel to the three matching flat inner surfaces in the housing, and extend substantially to the top of the housing when the chamber is contained therein as can be appreciated from FIGS. 5 and 7, for example.

Acoustic chamber 36 may be made with a variety of different internal configurations but with the same external shape as described above such that the various acoustic chambers are interchangeable in that any selected one of them will fit into housing 34. The acoustic chambers have different operating characteristics due to their different internal configurations. Different size internal chambers are particularly advantageous. Acoustic chamber 36 may, for example, be made with a cylindrical interior wall 58 within and spaced from side wall structure 50, with the interior wall fabricated with different heights and/or inner diameters for different applications and with a corresponding piezoelectric transducer mounted thereon. While the same transducer may be suitable for multiple applications, generally a different piezoelectric transducer will be used for each specified operating frequency.

Figure 8:
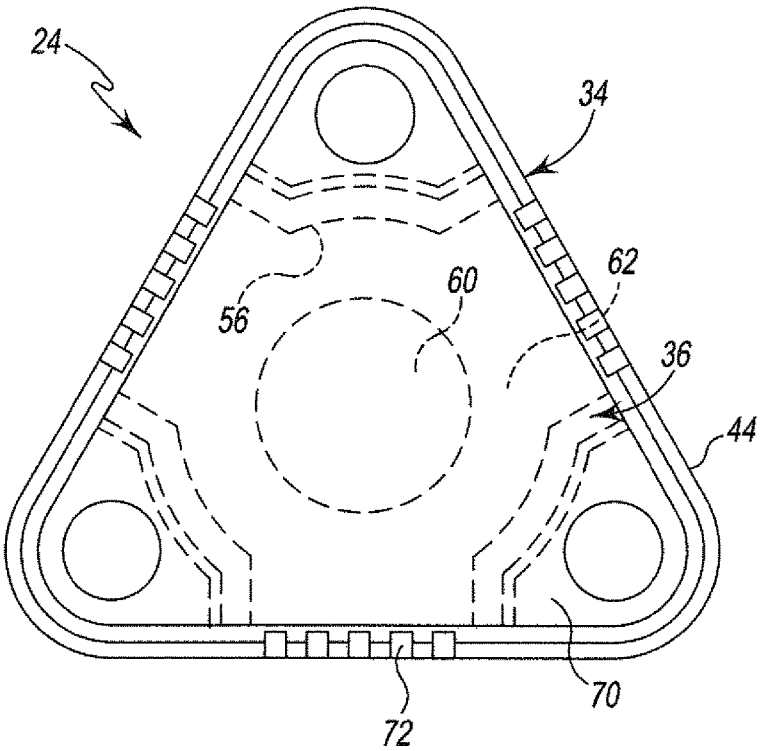
FIG. 8 is a bottom view of the sound section.

As shown in FIGS. 4-8, acoustic chamber 36 may include adjoining, coaxial chamber portions with different internal dimensions, e.g., a first portion 60 defined by an annular flange 58 and a wider second portion 62 below it having a generally cylindrical internal shape defined by cylindrically shaped side wall segments 56 (see especially FIG. 8, which shows, in broken lines, wall segments 56 and chamber portion 60 as well as adjoining interior walls of conduits 70 formed in the corners of housing 34). Flange 58 is supported by and extends axially upward from a transverse wall 64 connected to the side wall of acoustic chamber 36, as perhaps best seen in FIGS. 6 and 7, and has a piezoelectric transducer nodally mounted on the upper end thereof. In one embodiment, the flange height, and thus the transducer's longitudinal position within the acoustic chamber, is set according to desired output frequency. Alternatively, the flange diameter may be set according to the desired output frequency. For example, the flange height and diameter for a 2 kHz operating frequency may be as shown; for a 3 kHz operating frequency, the flange may be shorter; and, for a 4 kHz operating frequency, the flange may be shorter and narrower.

The upper end of the sound section is provided with an inset rim flange 66 to facilitate connection to a light section above it in the stack, as further described below. The transducer is connected via electrical wiring (not shown) to PCB 39, which may be seated above the transducer on the ledge 59 formed by the stepped cylindrical inner surface of side wall structure 50. PCB 39 is connected to external circuitry via electrical wiring (not shown) extending from the circuit board's upper surface up and through notches 68 formed in the upper edge of acoustic chamber 36, then passing longitudinally through closed-wall electrical conduits 70 in the housing corners, and through the associated circular holes in end wall 46, and thence through a central hole in end cap 42, and through pole 26 and its mounting bracket, both of which are made hollow for this purpose. The upper side of PCB 39 is sealed within chamber 36 with epoxy or other potting compound.

As one example set of suitable dimensions for the housing and acoustic chamber described above, the triangular housing may have a width of 2.7" on each side, and a height of 2.4". The piezoelectric transducer preferably has a fundamental resonant frequency in the mid-audio range, extending from approximately 1.5 to 4.5 kHz, with frequencies of approximately 2, 3, 3.5 and 4 kHz as particular examples. The transducer may be nodally mounted as described in U.S. Pat. No. 6,130,618, for example. Alternatively, edge mounts and center mounts may be useful for certain applications. Two-terminal and three-terminal piezoelectric transducers may be employed, and the latter may be energized by a drive circuit configured to generate positive feedback as disclosed, for example, in U.S. Pat. No. 8,674,817 or 3,815,129.

The side wall structure of acoustic chamber 36 defines three wide lateral openings 52 equiangularly spaced about the axis, and the side walls of external housing 34 define three corresponding slotted openings 72 adjacent end wall 46 and radially aligned with the acoustic chamber openings. Each lateral opening 52 has a height of 0.25" and width of 0.875" in its associated side wall segment 54 of the acoustic chamber, and a depth of 0.2" (the length of the flat inner wall surface extending inwardly perpendicular to the flat outer surface of wall segment 54). The width of the lateral opening may be determined based on the desired operating frequency of the device, and may, for example, be in the range of 8-25% of the wavelength of the piezoelectric transducer's fundamental frequency, i.e., from approximately one-twelfth to one-quarter wavelength. The lateral opening is approximately 0.875" wide in the disclosed embodiment, corresponding to approximately one-eighth wavelength for a 2 kHz transducer and approximately equal to the transducer's nodal diameter. The lateral openings in the housing each have multiple slots, e.g., five longitudinal slots in the disclosed embodiment, forming a side wall grille. End wall 46 is slightly open at its junction with the side wall openings 52, and it has three corner holes opening into corner conduits 70, but it is a substantially closed end wall.

A significant advantage of multiple lateral acoustic chamber openings is relatively equal 360-degree sound distribution. Panel mount audible devices are typically mounted on a machine panel that faces the operator who is operating and monitoring the machine. The sound emitted from the panel mount device disperses forward losing 6 dB of sound level every time the distance doubles. Someone standing to the side or behind the machine will hear a much diminished sound level or may not hear the sound at all. Indicator devices such as light towers are typically mounted above the machine so that anyone in the area (front, side, or behind) can hear and/or see the status of the machine. In this type of situation, it is desirable for the sound to be relatively equal in all directions. However, no known sound indicators mounted above machines emit sound evenly 360 degrees around the machine with maximum intensity. The above-described sound section with multiple acoustic sound chamber openings advantageously generates even 360-degree lateral sound dispersion at maximum intensity. The acoustic openings in the new sound section are not just slots or holes to let sound out but are an integral portion of the acoustic chamber causing sound waves to emerge at maximum intensity and disperse evenly.

Figure 9:
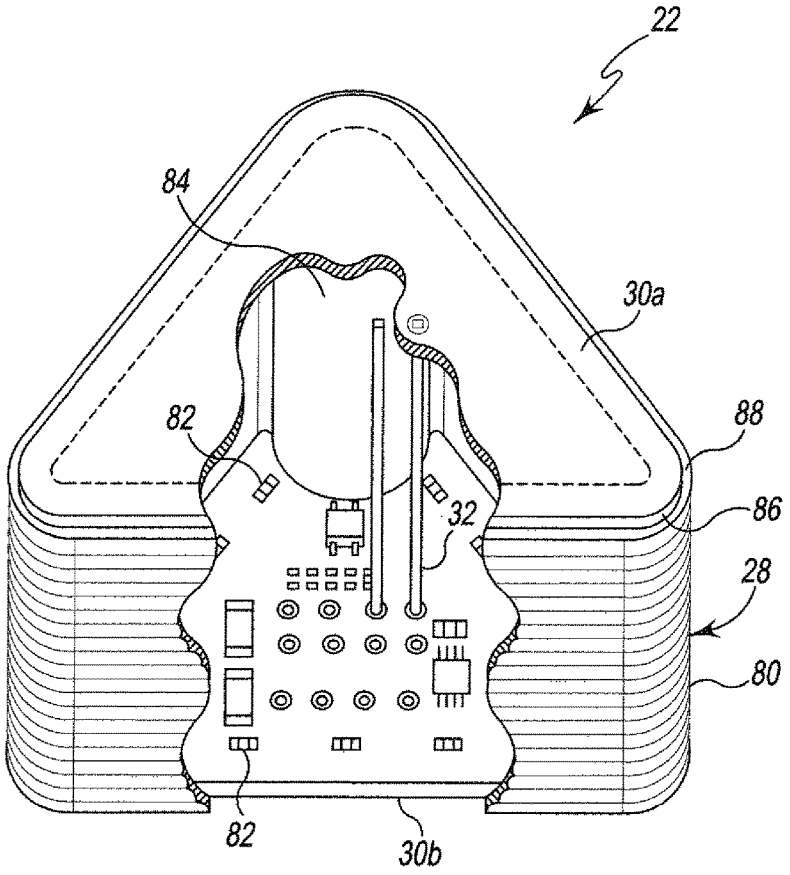
FIG. 9 is an upper perspective, partial cutaway view of a light section that may be utilized in the embodiments of FIGS. 1 and 2.
Figure 10:
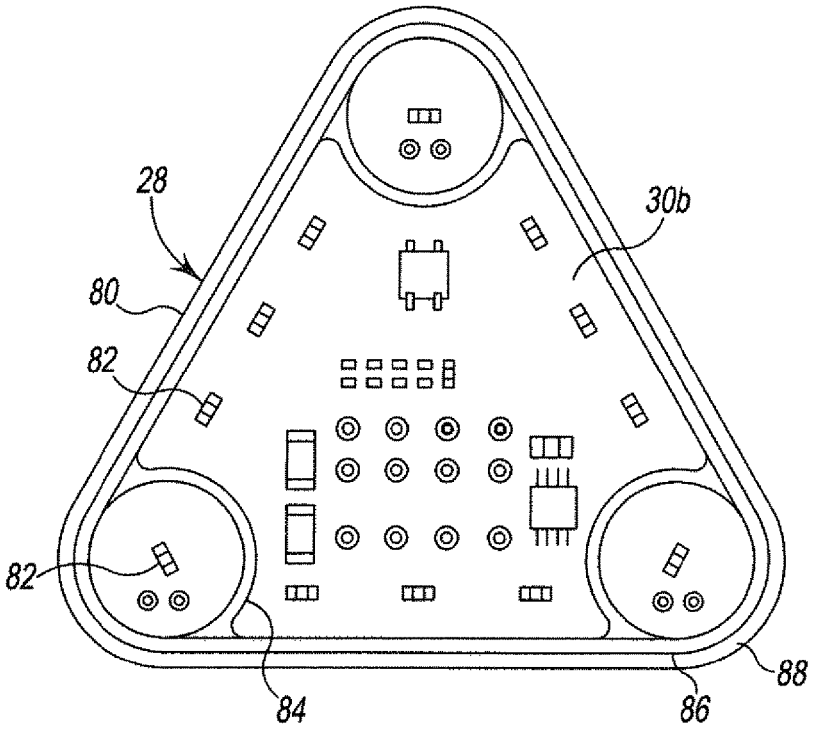
FIG. 10 is a top view of the housing and bottom circuit board in the light section of FIG. 9.

Referring now to FIGS. 9 and 10, another aspect of the present invention is a novel configuration of a light section using opposing light sources to produce a very even blended light, i.e., light with no externally visible bright spots which can be visually distracting or too bright for continuous viewing. FIGS. 9 and 10 illustrate one embodiment of a light section 22 according to the present invention. Light section 22 has a hollow housing 28 with printed circuit boards (PCBs) 30*a* and 30*b* attached on its upper and lower ends, respectively, and interconnected by rigid board-to-board connector pins 32 extending longitudinally through the housing. Each circuit board forms an end wall extending transversely between side walls 80 and has a plurality of light sources 82, preferably of the same color, peripherally mounted on its inner surface, i.e., the lower surface of circuit board 30*a* and the upper surface of circuit board 30*b*. Light emitting diodes (LEDs) are preferred light sources. However, miniature incandescent bulbs and other light sources may be useful in certain embodiments.

In the disclosed embodiment, each circuit board has surface-mount LEDs 82, e.g., Part No. HSMM-C170 commercially available from DigiKey, arranged in a triangular pattern around its periphery, with the LEDs connected in series and oriented for maximum emission parallel to the longitudinal axis. The circuit board may include an LED drive circuit of the type disclosed in U.S. Pat. No. 9,165,440, with an LED driver IC and a bridge rectifier. The LED pattern is perhaps best seen in FIG. 10, a top end view of the light section with the upper circuit board removed for illustration purposes. The PCB has one LED 82 mounted adjacent each vertex, substantially centered in an integrally formed hollow corner cylinder 84, and has mounting locations for up to three LEDs 82 between each two vertices as shown, adjacent the edge of the circuit board and the inner surface of side wall 80. It has been found suitable for yellow, green, blue and white LEDs to have one LED on each side, in the center position, with zero-ohm resistors in the two adjacent locations, and for red to have a zero-ohm resistor in the center and a red LED in each of the other two locations.

The side wall inner surfaces are flat and smooth. The housing is totally translucent in the disclosed embodiment, although it may be partially translucent or transparent and partially opaque. The side wall thickness is approximately 0.12". The side wall outer surfaces preferably have closely spaced alternating ridges and grooves perpendicular to the longitudinal axis of the stack light and extending completely around the periphery and from top to bottom. As one suitable example, the groove-to-groove spacing may be 0.035", and the ridge height may be the same. Such a grooved surface may be provided instead, or in addition, on the inner surfaces of the side walls. The grooved surfaces diffuse light from the internal light sources, as do the corner cylinders. The inner halves of the corner cylinders also reflect light outwardly from the LEDs mounted at the vertices of the triangular lens housing, thereby avoiding dim spots and contributing to the even distribution of light from each light section.

The opposite ends of each light section may be provided with complementary male and female rim portions to facilitate interconnection of light sections. In the disclosed embodiment, the top of housing 28 has an inset rim flange 86 and adjoining exterior shoulder 88, and the bottom of the housing has a complementary recess in its side wall forming an interior shoulder. Top end cap 40 similarly has a complementary recess for mating connection to the top of the top light section in the stack light. Inset rim flange 66 and its adjoining exterior shoulder on the upper end of the sound section likewise form a male rim portion to facilitate connection to a light section, and the bottom of the sound section housing is provided with a complementary peripheral groove in the outer surface of end wall 46 as shown (lower left) in the cross-section in FIG. 7. Bottom end cap 42 has a male rim portion for mating connection to the peripheral groove in end wall 46. The depth of each such recess or groove preferably equals or exceeds the height of each rim flange above its adjoining shoulder such that there is no gap between the exterior surfaces of the mating parts, although a small gap may be suitable for certain applications.

Alternative embodiments are contemplated in which a sound section is mounted on top of a light section such as described above, as well as embodiments in which the stack light includes multiple stacked sound sections in addition to one or more of the light sections described above, with electrical connections to the transducer(s) made via wires or board-to-board connector pins extending through the various sections, e.g., through conduits 70 in the sound section corners and corner cylinders 84 in the light section(s). A stack light incorporating the principles of the present invention may have wireless alarm communication capability, as described in U.S. Pat. No. 9,030,318, for one or more permanently attached light and/or sound sections of the stack. Or a stack light system may have a detachable wireless alarm, with sound and/or light indicators, or a separate wireless alarm configured for mounting on a machine control panel or the like, as also described in U.S. Pat. No. 9,030,318.

Corner cylinders 84 are preferably axially recessed within the housing on both ends to provide seats for the circuit boards. For example, the upper edge of each cylinder may be recessed below the top of rim flange 86 by an amount equal to the thickness of circuit board 30*a*, e.g., 0.063", and the lower edge may be recessed above the plane of the interior shoulder by an amount equal to the thickness of circuit board 30*b*, e.g., 0.063", whereby circuit board 30*a* is seated on the cylinders with its top (outer) surface flush with the top of the rim flange and circuit board 30*b* is seated with its bottom (outer) surface flush with the interior shoulder. It has been found preferable to provide a smaller recess for the upper edge of each cylinder, e.g., half the circuit board thickness, and to adjust the lower edge recess, so that the circuit board is disposed partially above the rim flange and thereby straddles the line of contact between the rim flange of one lens and the interior shoulder of a lens above it in the stack, with the circuit board bearing against the interior surfaces of the lenses above and below the line of contact.

Connector pins 32 interconnect circuit boards 30*a* and 30*b* both electrically and mechanically, supplying power between the LED drive circuits on the two circuit boards. The space between the circuit boards in the interior of the housing is otherwise empty except for the interior corner cylinders. The same light section may be used with others of the same design in a stack light having multiple light sections, such as stack light 10 of FIG. 1, except as will now be described. A common power line is connected to all light sections via series-connected board-to-board connector pins 32. In addition, each light section is preferably independently controllable via an individual control line passing through any lower sections in the stack light via a separate set of series-connected board-to-board connector pins.

In the assembly process, the connector pins for a given light section are first placed in mounting holes provided for them in the lower circuit board, PCB 30*b*, and, while being held parallel to each other and perpendicular to the plane of the board, the pins are soldered to PCB 30*b*. A lens 28 is then placed on PCB 30*b*, and then the upper circuit board, PCB 30*a*, is placed on the lens with the pins aligned with associated through holes in the upper board so as to extend therethrough. To facilitate such pin installation, each circuit board has an electrically connected pair of through holes for the common power line, and a similar pair of holes for each control line. Thus, for any such line that extends through more than one light section, one such hole is used for a pin connecting the board to the board above it and the other hole is used for the companion pin connecting the board to the board below. Connector pins 32 thus interconnect all the circuit boards in the stack light and thereby help hold adjacent light sections together. The light sections are also glued together at their peripheries. The connector pins advantageously provide electrical interconnections centrally within the light sections and thereby avoid obstructing the field of view of the peripherally mounted LEDs.

The power line and control lines for all light sections have associated wiring terminals adjacent the corners on the bottom light section's lower circuit board, which terminals are connected to an external controller via electrical wiring extending through conduits 70 in the corners of the sound section housing, through the central hole in end cap 42, and through hollow pole 26 and its mounting bracket.

A stack light with light and sound sections as described above is not limited to certain shapes as are known stack lights which typically use round shaped housings because their centrally located light sources would not work well with other shapes which would result in light and dark spots or bands due to the differing distances from the light source to the various portions of the lens. Because the stack light disclosed herein uses opposing light sources and a special acoustic chamber with multiple acoustic openings, the external shape of the device does not affect its performance. This allows the cross-sectional shape of the indicator device to be square, triangular, octagonal, etc.

A triangular stack light with rounded corners such as described above is a polygonal stack light of particular interest, as is a rectangular shaped device with rounded corners. Such a device could be top mounted, wall mounted, or corner mounted. Round indicator devices work well when mounted above a machine, but do not fit well or look appropriate when wall or corner mounted.

In the preferred embodiment, the stack light has different color light sections, e.g., red, yellow, green, blue, white, etc., with LEDs of the same color on the opposing circuit boards of each light section. All the circuit boards are preferably two-sided printed circuit boards, and adjacent light sections share a printed circuit board as an interface, each board having different color LEDs on opposite sides thereof. Circuit boards not functioning as such an interface have circuit components mounted on only one side, i.e., the side facing into the associated light section, e.g., the uppermost or lowermost light section.

While each light section and sound section may be isolated such that control of each section is independent of each other, a desirable alternative is to have a controller configured to control different light sections so as to produce a blended color, and further to tie together both the light and sound sections of the indicator device. U.S. Pat. No. 9,165,440 gives examples of combined light and sound control using a controller, and, as an improvement thereon, the stack light disclosed herein may be configured to generate complex sound and light patterns which make the device much more useful in identifying the state of a machine by both audible and visual means. As one example, the stack light may have a controller configured to have a light pulse to match a selected sound. Other combinations of light and sound patterns are envisioned for embodiments of the present invention, including, for example, those described in U.S. Pat. Nos. 6,310,540, 8,674,817, and 9,165,440. In a variation of the above-disclosed example of a stack light having a single light section and a single sound section, a common internal controller is provided for both sections, and the light section is capable of emitting different colors of light and the sound section is capable of emitting a variety of sounds, e.g., four user-selected sounds as described below, with the light and sound tied together which offers more functionality in a small compact package.

The stack lights of FIGS. 1 and 2 have four user-selectable sound options. More specifically, the sound section has a control circuit on PCB 39 of the type disclosed in U.S. Pat. No. 9,165,440, the circuit including a microcontroller and piezoelectric horn driver with the microcontroller programmed to generate four different sounds through the piezoelectric transducer: 1) a continuous tone; 2) a pulse tone having, e.g., 5 pulses/second; 3) an intermittent pulse train having, e.g., 2 pulses every other second; and 4) a continuous tone followed by a pulse tone of, e.g., 1 pulse/second. A desired one of the four available sounds is selected via the state of two control input lines to the microcontroller from an external controller, e.g., a controller for the machine with which the stack light is used.

Unless stated otherwise, the parts and features shown and described herein are simply examples in disclosed embodiments and are not essential to the present invention. All of the above-referenced patents are hereby incorporated by reference in their entireties along with all patents and patent application publications cited therein.

While the invention has been illustrated and described in detail in the drawings and foregoing description, the same is to be considered as illustrative and not restrictive in character, it being understood that only preferred embodiments have been shown and described and that all changes and modifications that come within the spirit of the invention are desired to be protected.

We claim:

1. An industrial stack light indicator device, comprising:

an industrial indicator device light section having a housing with a plurality of at least partially translucent side walls and a plurality of opposing light sources of like color on longitudinally opposite ends of said housing;

wherein each end of said light section housing has an end wall extending transversely between said side walls with a plurality of light sources peripherally mounted on an inner surface thereof, each end wall being a printed circuit board including multiple LEDs and an LED drive circuit, said light section including a plurality of conductors electrically interconnecting said spaced circuit boards;

further comprising a second light section, wherein one of said printed circuit boards is an interface between said light sections and has different color LEDs on opposite sides thereof.

2. An industrial stack light indicator device, comprising:

an industrial indicator device light section having a housing with a plurality of at least partially translucent side walls and a plurality of opposing light sources of like color on longitudinally opposite ends of said housing;

further comprising a sound section on a common longitudinal axis with said light section, said sound section having a housing and a sound generating element within said housing, said housing and sound generating element together defining a resonant cavity having at least one orifice open to the environment, wherein said sound section housing has a substantially closed end wall and an adjoining side wall structure having a plurality of lateral openings adjacent said end wall and equiangularly spaced about said axis.

3. The stack light of claim 2, wherein said light and sound sections have a generally polygonal transverse cross-section.

4. A stack light system with stacked light and sound sections aligned on an axis, comprising:

a light section having a housing with a light source therein;

a sound section having a hollow housing and a set of differently configured interchangeable acoustic chambers configured for insertion into said hollow housing, each chamber including a piezoelectric transducer and having a side wall structure distinct from said piezoelectric transducer and configured to abut an inner side wall surface of said housing, said chamber, transducer and housing together defining a resonant cavity, said set of differently configured acoustic chambers including acoustic chambers with different size internal chambers within the space defined by said side wall structure.

5. A stack light system with stacked light and sound sections aligned on an axis, comprising:

a light section having a housing with a light source therein;

a sound section having a hollow housing and a set of interchangeable acoustic chambers configured for insertion into said hollow housing, each chamber including a piezoelectric transducer and having a side wall structure configured to abut an inner side wall surface of said housing, said chamber, transducer and housing together defining a resonant cavity, wherein said side wall structure of each acoustic chamber includes a plurality of flat outer surfaces and said hollow housing includes a matching plurality of flat inner surfaces.

6. The system of claim 5, wherein said acoustic chambers contain said piezoelectric transducers at different respective positions.

7. The system of claim 6, wherein each acoustic chamber includes axially aligned first and second portions of different internal width.

8. The system of claim 7, wherein said first and second chamber portions are internally generally cylindrical, said first portion having a smaller internal diameter and located between said piezoelectric transducer and said second portion.

9. The system of claim 8, wherein said first and second chamber portions adjoin each other and said acoustic chamber has a transverse wall at the junction thereof, with an annular flange extending axially from said transverse wall and defining said first chamber portion, and said transducer is nodally mounted on said annular flange.

10. The system of claim 9, wherein said side wall structure of each acoustic chamber defines a plurality of lateral openings equiangularly spaced about said axis; and wherein said hollow housing has a substantially closed end wall and an adjoining side wall structure having a plurality of lateral openings adjacent said end wall and radially aligned with said acoustic chamber lateral openings.

11. The system of claim 5, wherein said side wall structure of each acoustic chamber defines a plurality of lateral openings equiangularly spaced about said axis; and wherein said hollow housing has a substantially closed end wall and an adjoining side wall structure having a plurality of lateral openings adjacent said end wall and radially aligned with said acoustic chamber lateral openings.

12. A stack light with light and sound sections on a common longitudinal axis, comprising:

a light section having a housing with a light source therein;

a sound section having an acoustic chamber with a piezoelectric transducer, a longitudinally extending side wall, and a substantially closed end wall, said side wall having adjacent said end wall a plurality of wide lateral openings spaced apart along its perimeter, said openings each having a width in the range of approximately 8-25% of the wavelength of the piezoelectric transducer's fundamental frequency.

13. The stack light of claim 12, wherein said sound section includes an external housing enclosing an open-ended acoustic chamber core, with said side wall a part of said core and said end wall a part of said external housing.

14. The stack light of claim 13, wherein said end wall is flat and the space enclosed within said acoustic chamber by said transducer, side wall and end wall is free space.

15. The stack light of claim 14, wherein said external housing has a plurality of grilles radially aligned with said lateral openings in said acoustic chamber side wall.

16. The stack light of claim 15, wherein said light and sound sections have a generally polygonal transverse cross-section.

17. A stack light with light and sound sections aligned on an axis, comprising:

a light section having a housing with a light source therein;

a sound section having a hollow housing and an acoustic chamber configured for insertion into said hollow housing, said chamber including a piezoelectric transducer and having a side wall structure configured to abut an inner side wall surface of said housing, said chamber, transducer and housing together defining a resonant cavity, wherein said side wall structure includes a plurality of flat outer surfaces and said hollow housing includes a matching plurality of flat inner surfaces.

18. The stack light of claim 17, wherein said acoustic chamber includes axially aligned first and second portions of different internal width.

19. The stack light of claim 18, wherein said first and second chamber portions are internally generally cylindrical, said first portion having a smaller internal diameter and located between said piezoelectric transducer and said second portion.

20. The stack light of claim 19, wherein said first and second chamber portions adjoin each other and said acoustic chamber has a transverse wall at the junction thereof, with an annular flange extending axially from said transverse wall and defining said first chamber portion, and said transducer is nodally mounted on said annular flange.

21. The stack light of claim 20, wherein said side wall structure defines a plurality of lateral openings equiangularly spaced about said axis; and wherein said hollow housing has a substantially closed end wall and an adjoining side wall structure having a plurality of lateral openings adjacent said end wall and radially aligned with said acoustic chamber lateral openings.

22. The stack light of claim 17, wherein said side wall structure defines a plurality of lateral openings equiangularly spaced about said axis; and wherein said hollow housing has a substantially closed end wall and an adjoining side wall structure having a plurality of lateral openings adjacent said end wall and radially aligned with said acoustic chamber lateral openings.

* * * * *